US006364213B1

(12) United States Patent
Baltz

(10) Patent No.: US 6,364,213 B1
(45) Date of Patent: Apr. 2, 2002

(54) ENGINE COOLING SYSTEM

(75) Inventor: Gene Frederic Baltz, Olmsted Falls, OH (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/681,507

(22) Filed: Apr. 18, 2001

(51) Int. Cl.[7] ..... B60H 1/02
(52) U.S. Cl. ..... 237/12.3 B; 123/41.01
(58) Field of Search ..... 237/12.3 B, 12.3 R; 123/41.01, 41.02; 165/42

(56) References Cited

U.S. PATENT DOCUMENTS

| | | | | |
|---|---|---|---|---|
| 3,014,467 A | | 12/1961 | Middendorf et al. | |
| 3,759,233 A | | 9/1973 | Shaeffer et al. | |
| 4,156,408 A | | 5/1979 | Protze | |
| 4,320,798 A | | 3/1982 | Obernberger | |
| 4,425,877 A | | 1/1984 | Fritzenwenger | |
| 4,510,893 A | * | 4/1985 | Schweiger et al. | 123/41.02 |
| 4,895,301 A | | 1/1990 | Kennedy | |
| 4,993,628 A | * | 2/1991 | Reynolds | 236/34.5 |
| 5,117,898 A | | 6/1992 | Light et al. | |
| 5,410,991 A | * | 5/1995 | Beaudry et al. | 123/41.1 |

* cited by examiner

*Primary Examiner*—Harold Joyce
*Assistant Examiner*—Derek S. Boles
(74) *Attorney, Agent, or Firm*—Ford Global Tech., Inc.

(57) ABSTRACT

An integrated fluid recovery reservoir and thermostat assembly 12 for use within an engine cooling system 10. The integrated fluid recovery reservoir and thermostat assembly 12 includes a coolant reservoir housing 26 which is mounted directly to the engine 14 and which includes inlet ports 28, 30 for receiving coolant 38 from engine 14 and an outlet flow portion or module 46 which is fluidly coupled to the radiator 18. The assembly 10 further includes a flow control module and thermostat assembly 42 which is attached to the reservoir housing 26 and which selectively and fluidly communicates with the reservoir housing 26, with the coolant pump 20 and with the radiator 18. A thermostat valve 72 is attached to and/or within assembly 42 and cooperates with assembly 42 to selectively control the flow of the coolant 38 through the engine cooling system 10. The thermostat 72 is integrated within a fill cap 54, which allows the system 10 to be easily filled with coolant and allows the thermostat 72 to be easily serviced or replaced.

19 Claims, 5 Drawing Sheets

ENGINE COOLING SYSTEM

BACKGROUND OF THE INVENTION

The present invention generally relates to an engine cooling system and more particularly, to an engine cooling system which utilizes an engine mounted cooling recovery reservoir for reduced cooling system complexity, and a thermostat which is integrated within the reservoir fill cap, thereby allowing the thermostat to be easily changed and/or removed and allowing the system to be easily filled and serviced.

In order to cool an engine, a vehicle typically circulates a liquid coolant such as water through the engine and through a heat exchanger (e.g., a radiator) which allows the coolant or water to be desirably cooled. Before the vehicle's engine reaches a certain temperature, the coolant bypasses the heat exchanger and is used to heat the engine components and the vehicle passenger compartment. Particularly, in cold temperatures, the heated water is typically channeled through a heater core, while air is forced through the heater and communicated to the passenger compartment of the vehicle, thereby desirably increasing the temperature of the passenger compartment. Once the temperature of the coolant exceeds a certain level, a "thermostat" is actuated and causes the heated coolant to pass through the radiator. The thermostat includes a wax pellet or element that is heated by the water, and which is effective to expand, thereby actuating a valve within the thermostat, and allowing the coolant to pass through the radiator.

During engine "warm up", the bypass coolant flow circuit is positioned so that coolant flowing through the engine is channeled to the thermostat, which is typically disposed on the "cold-side" of the radiator, and which receives the coolant prior to the coolant passing through the heater core. Because of this positioning, the operation of the thermostat is governed by the temperature gradient across the entire engine cooling system. As a result, the operation of the thermostat is controlled by the bypass flow rather than the flow through the heater core. If coolant flow from the heater circuit is directed onto the thermostat (rather than bypass flow), then gains in heater performance are achieved due to the thermostat control governed by heater circuit demand.

These vehicle heating and cooling systems also require a relatively large amount of hoses or conduits which interconnect the various components of the cooling system such as the radiator, the coolant recovery reservoir, the engine, the heater core, and the thermostat. This network is relatively complex and provides various potential sources for leaks. Furthermore, these prior systems are relatively difficult to fill, due to this large network of hoses and due to restrictions created by the closed thermostat in the coolant flow circuit. Lastly, the placement of the radiator height position relative to engine height position and reservoir height position creates fill issues due to air entrapment resulting from these varying positions.

There is therefore a need for a new and improved engine cooling system which includes a coolant recovery reservoir which is mounted to the engine, which has an integrated thermostat and refill cap, and which greatly reduces the complexity of the system relative to prior systems.

SUMMARY OF INVENTION

A first non-limiting advantage of the invention is that it provides an engine cooling system which integrates the coolant recovery reservoir as an engine mounted component for reduced cooling system complexity, hose routing simplification, and a reduction in the number of potential leak source connections.

A second non-limiting advantage of the invention is that it integrates a thermostatic control device into the reservoir cap for ease of coolant filling during vehicle assembly and field service. This also allows the thermostat to be replaced manually without the need for service tools or draining of the cooling system.

A third non-limiting advantage of the invention is that it places the coolant recovery reservoir at a high elevation relative to the engine, heater core and radiator, thereby improving cooling system function and simplifying initial vehicle fill and serviceability. Moreover, because the thermostat is integral with the reservoir fill cap, the system may be filled faster, as the thermostat is entirely removed from the system during the fill procedure, thereby eliminating any restriction during system filling.

A fourth non-limiting advantage of the invention is that it allows for both a conventional wax pellet type thermostat design or an electronic thermostat design which may be selectively controlled by the engine control module or microprocessor.

A fifth non-limiting advantage of the invention is that it reroutes vehicle cabin heater coolant to the thermostat for improved vehicle cabin heater performance under cold ambient conditions of engine transitional warm-up.

A sixth non-limiting advantage of the invention is that it utilizes a design which prevents overfilling of the coolant reservoir during service filling.

A seventh non-limiting advantage of the invention is that it allows the coolant recovery reservoir to be installed during engine assembly for improved leak testing and functional testing prior to installation in a vehicle.

An eighth non-limiting advantage of the invention is that it reduces cooling system fluid volume which reduces the overall system weight and cost.

A ninth non-limiting advantage of the invention is that it utilizes a reservoir design which eliminates steam bubbles from the coolant prior to the coolant entering the radiator, thereby improving heat transfer within the radiator.

A tenth non-limiting advantage of the invention is that it provides full control of the coolant bypass circuit for improved engine warm-up and cooling system performance.

An eleventh non-limiting advantage of the present invention is that it provides an electronically controlled thermostat which results in improved overall system performance, such as faster warm-up in cold ambient conditions, reduced high speed restriction, and which allows for the selective programming of the cooling system and variable engine temperature control for improved drivability, performance and optimal emission control.

According to a first aspect of the present invention, an integrated fluid recovery reservoir and thermostat assembly is provided for use within an engine cooling system of the type including an engine, a radiator, coolant and a pump which selectively circulates the coolant through the engine and the radiator. The assembly includes a coolant reservoir housing which is mounted to the engine and which includes at least one inlet port for receiving coolant from the engine and an outlet flow portion which is fluidly coupled to the radiator; a flow control module which is attached to the reservoir housing and which selectively and fluidly communicates with the reservoir housing, with the pump and with the radiator; and a thermostat assembly which is attached to the flow control module, and which cooperates with the flow control module to selectively control the flow of the coolant through the engine cooling system. The thermostat assembly includes a valve which is selectively movable between a first position in which the coolant bypasses the radiator and flows directly from the reservoir housing to the pump, and a second position which causes the coolant to be selectively channeled from the reservoir housing through the radiator prior to being channeled to the pump.

According to a second aspect of the present invention, a method is provided for channeling coolant within an engine cooling system including an engine, a radiator and a pump. The method includes the steps of: providing a coolant reservoir housing; mounting the coolant reservoir housing to the engine; fluidly coupling the coolant reservoir housing to the engine and to the radiator; providing a fill cap for the coolant reservoir housing; integrating a thermostat assembly within the fill cap for selectively channeling the coolant to the radiator; coupling the thermostat assembly to the radiator and the pump; and causing the thermostat assembly to selectively channel the coolant to the radiator based upon the temperature of the coolant.

These and other features, aspects, and advantages of the present invention will become apparent from a reading of the following detailed description of the preferred embodiment of the invention and by reference to the following drawings.

DETAILED DESCRIPTION

Figure 1:
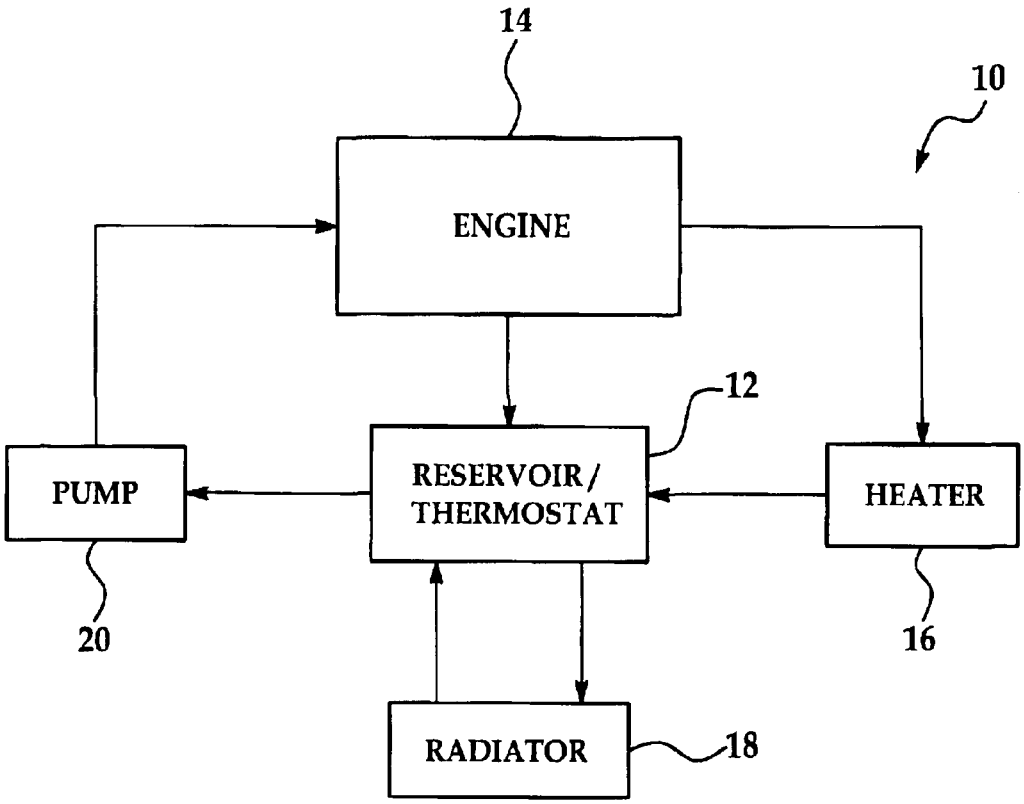
FIG. 1 is a block diagram of an engine cooling system which is made in accordance with the teachings of a preferred embodiment of the invention.

Referring now to FIG. 1, there is shown a block diagram of an engine cooling system 10 which includes an integrated coolant recovery reservoir and thermostat assembly 12 which is made in accordance with the teachings of the preferred embodiment. In the preferred embodiment of the invention, system 10 is used within an automotive vehicle.

System 10 utilizes engine coolant (e.g., water) to heat and cool a conventional engine 14, and a conventional vehicle heater core or assembly 16. System 10 includes radiator 18, pump 20 and integrated reservoir and thermostat assembly 12, which is mounted and fluidly coupled to engine 14. Heater assembly 16 is fluidly coupled to and receives heated coolant from engine 14 and uses the received heated coolant to heat the passenger compartment of the vehicle in a conventional manner. Heater assembly 16 is also fluidly coupled to assembly 12, and once the coolant passes through heater assembly 16, it is communicated to the thermostat portion of assembly 12. Based upon the temperature of the coolant received from heater assembly 16, assembly 12 either channels the coolant through radiator 18 or bypasses the radiator 18 and channels the coolant directly to the pump assembly 20 which communicates the coolant back through engine 14. Particularly, once the coolant received from heater core 16 exceeds a predetermined and/or calibratable temperature, assembly 12 selectively channels the cooling fluid to the radiator 18, thereby cooling the fluid prior to channeling the fluid back through pump 20 and into engine 14.

Figure 2:
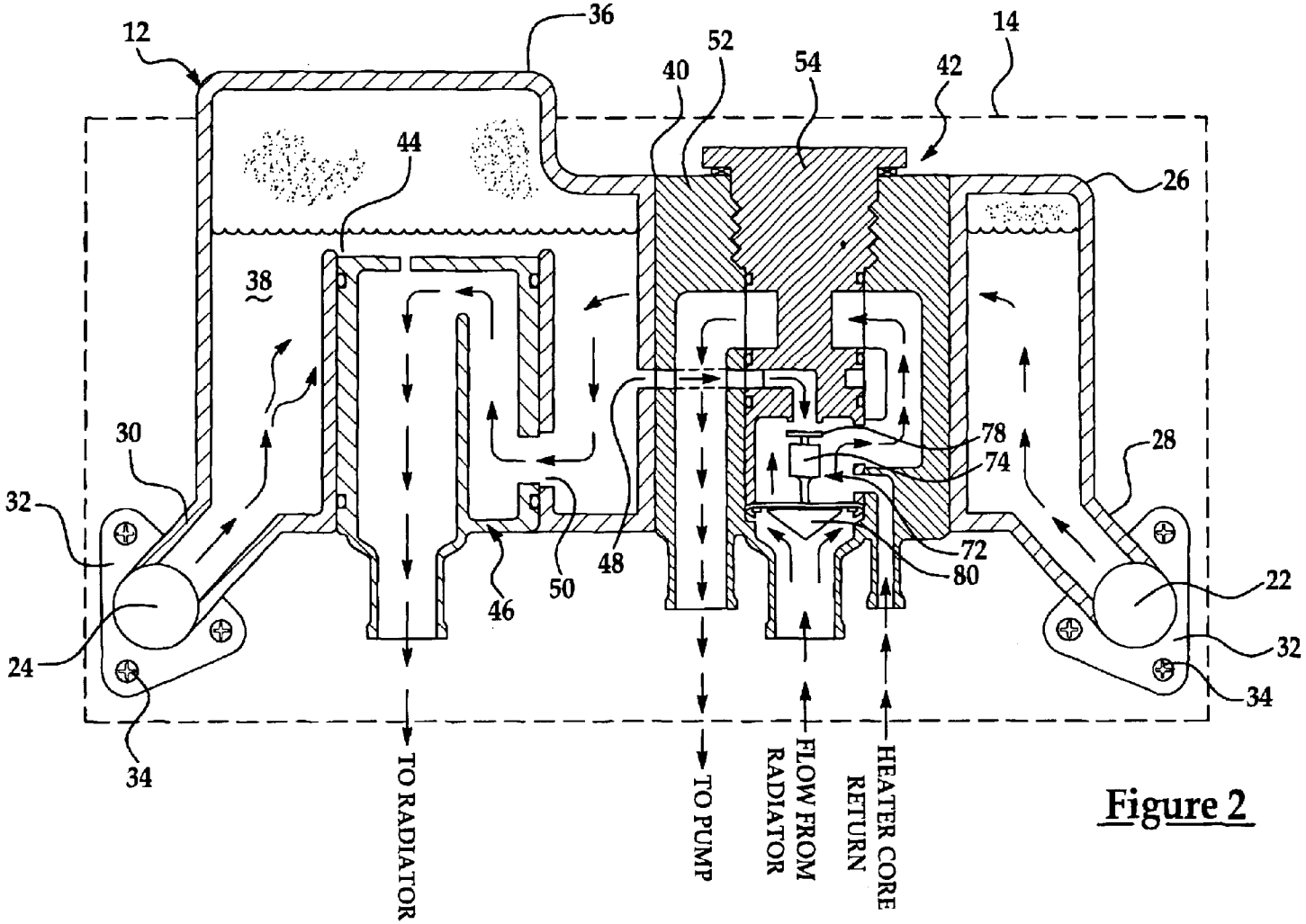
FIG. 2 is a sectional view of an integrated reservoir and thermostat assembly which is used within the cooling system shown in FIG. 1.

Referring now to FIG. 2, there is shown the integrated fluid recovery reservoir and thermostat assembly 12, which is mounted to engine 14. In the preferred embodiment, engine 14 comprises a conventional "V"-type engine having a pair of cooling conduits 22, 24, which respectively communicate with the cooling chambers of the right and left cylinder banks of the engine 14.

Assembly 12 includes a generally rectangular reservoir housing 26 having ports 28, 30 which are respectively attached and/or fluidly coupled to conduits 22, 24 in a conventional manner. In other alternate embodiments, housing 26 may be modified (e.g., different numbers or arrangements of ports may be used) to conform to other types of engine configurations, such as a conventional "in-line" type engine. Housing 26 receives and holds coolant 38 from conduits 22 and 24. In the preferred embodiment, reservoir housing 26 is mounted directly to engine 14 in a conventional manner (e.g., by use of brackets 32 and fasteners 34). By mounting assembly 12 directly to engine 14 and coupling ports 28, 30 directly to conduits 22, 24, the present system simplifies routing, requires less hoses, and reduces the number of potential leak sources. This direct engine mounting architecture further places the coolant recovery reservoir at a high elevation relative to the engine (and relative to prior designs). This improves cooling system function, simplifies the initial cooling system filling procedure and prevents air-entrapment during the fill procedure.

Reservoir housing 26 further includes a raised "air dome" chamber portion 36, which is located at the top of the reservoir and at the highest point in the cooling system relative to the other components and flow paths. The chamber 36 allows for thermal expansion of the coolant over the pressure gradient of the cooling system. Moreover, the chamber 36 prevents "over-filling" of the system 10, as it is located at a higher point than the fill cap/thermostat 54.

Housing 26 further includes a generally cylindrical integrally formed channel 40 which houses a flow control module and thermostat assembly 42, and a generally cylindrical integrally formed cavity 44 which houses a radiator outlet flow module 46. The portion of housing 26 that forms and/or defines channel 40 includes an aperture 48, which allows the interior of housing 26 (e.g., the coolant 38 within housing 26) to communicate with the assembly 42. The portion of housing 26 that forms and/or defines cavity 44 includes an aperture 50, which allows the interior of housing 26 (e.g., the coolant 38 within housing 26) to communicate with outlet flow module 46.

Figure 3:
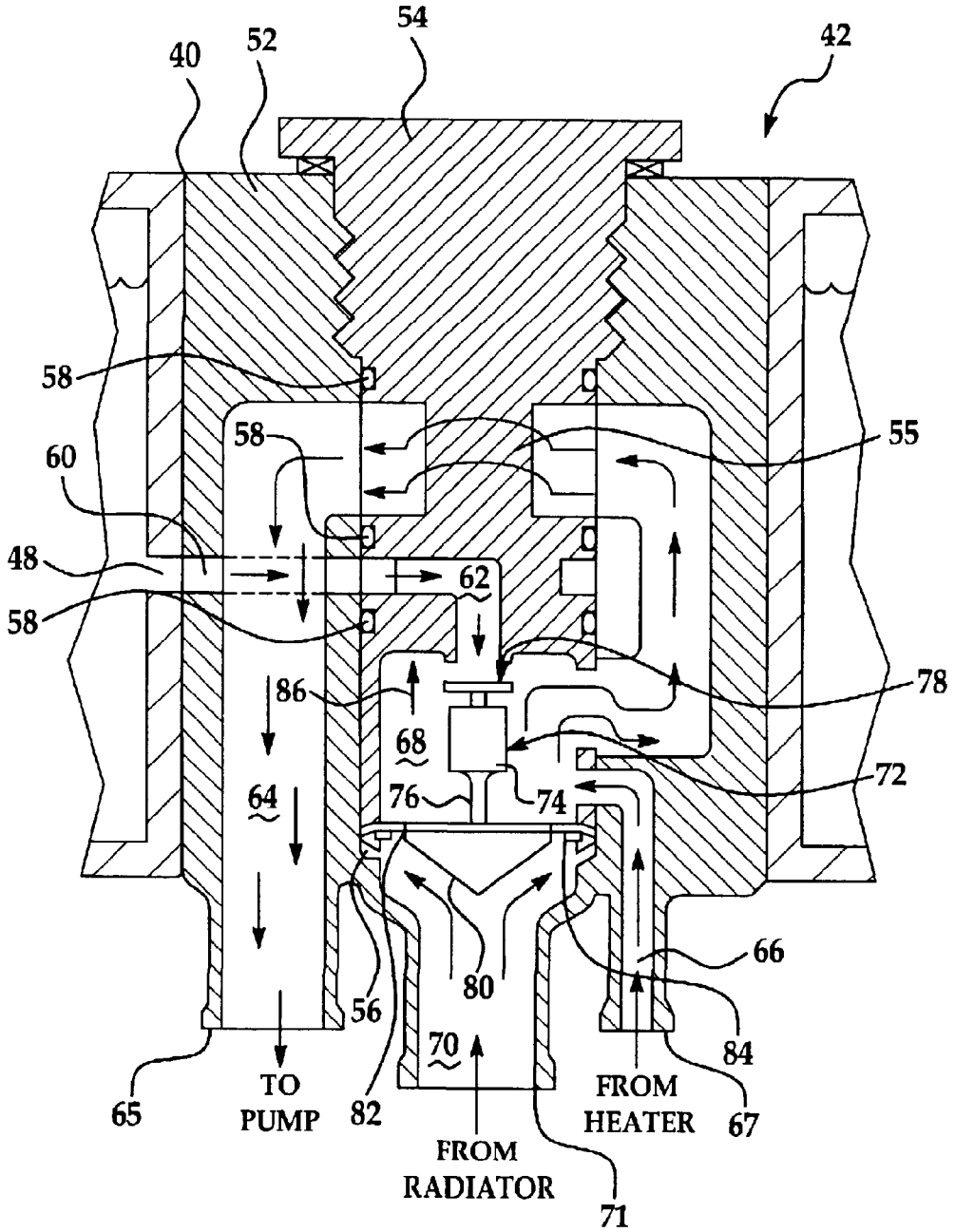
FIG. 3 is a partial view of the integrated reservoir and thermostat assembly shown in FIG. 2 and illustrating a flow control module and a thermostat which is integrated into the reservoir refill cap of the assembly.

Referring now to FIG. 3, there is shown flow control module and thermostat assembly 42. Assembly 42 includes an outer flow control module 52 which is attached to housing 26 and sealed within channel 40 in a conventional manner (e.g., by use of a sonic welding procedure), and an integrated reservoir fill cap and thermostat assembly 54 which is threadingly coupled to portion 52 and which cooperates with portion 52 to cause coolant 38 to either bypass the radiator 18, or to allow coolant to flow to radiator 18.

Integrated fill cap and thermostat assembly 54 resides within a central channel 56 formed within portion 52. Assembly 54 includes several conventional o-rings 58 which provide seals between assembly 54 and portion 52 and which prevent coolant 38 from passing outside of the various flow paths formed within assembly 42.

Outer flow control module 52 includes a first integrally formed channel 60 which communicates with aperture 48 and bypass channel 62 which is formed within thermostat assembly 54 and which selectively communicates with thermostat chamber 68. Portion 52 further includes a second integrally formed channel 64 which is communicatively coupled to pump 20 through port 65, and a third integrally formed channel 66 which is communicatively coupled to thermostat chamber 68 and to heater 16 through port 67. Channel 66 communicates coolant 38 which has passed through heater 16 into the thermostat chamber 68. Portion 52 further includes a radiator inlet channel 70 which is fluidly coupled to radiator 18 through port 71, and which selectively receives coolant 38 from radiator 18 and communicates with thermostat chamber 68, as described more fully and completely below.

In the preferred embodiment of the invention, integrated fill cap and thermostat assembly 54 includes a narrowed portion 55 which is aligned with channel 64 when thermostat assembly 54 is fully attached to portion 52, thereby allowing coolant to pass "around" portion 55 and traverse channel 64. Assembly 54 further includes a wax-type valve or thermostat 72 which is disposed within the chamber 68. Valve 72 includes a conventional wax element or pellet 74, and a shaft 76 which is movable therein. Shaft 76 includes a first valve end 78 which selectively covers the opening to channel 62, thereby selectively preventing coolant from flowing through bypass channel 62. Shaft 76 further includes a second valve end 80 which selectively covers an aperture 82 formed within plate 84 which separates conduit 70 from chamber 68, thereby selectively preventing coolant from flowing from the radiator 18 to pump 20 through channel 64.

When thermostat 72 is subjected to relatively cold temperatures (e.g., when the coolant 38 passing into chamber 68 from heater 16 is relatively cold) during engine "warm up", the thermostat 72 remains in the position shown in FIG. 2, and blocks flow from the radiator 18, thereby causing all of the coolant 38 to bypass the radiator 18. When thermostat 72 is subjected to relatively hot temperatures (e.g., the coolant 38 passing into chamber 68 from heater 16 is relatively hot or exceeds some predetermined temperature), the wax within element 74 expands and forces shaft 76 in the direction of arrow 86, effective to block bypass channel 62 and to open aperture 82, thereby causing all of the coolant 38 to flow through radiator 18 (from outlet flow module 46). By routing the vehicle cabin heater coolant to the thermostat 72 through channel 66, system 10 improves vehicle cabin heater performance under cold ambient conditions of engine transitional warm-up, because more time will elapse before the thermostat 72 actuates and routes the coolant 38 through the radiator 18.

It should be appreciated that by integrating the thermostat 72 within the threaded refill cap assembly 54, the present invention allows coolant to be easily filled during vehicle assembly and field service. This design also allows the entire thermostat and refill cap assembly 54 to be replaced manually without the need for service tools or draining of the cooling system.

Figure 4:
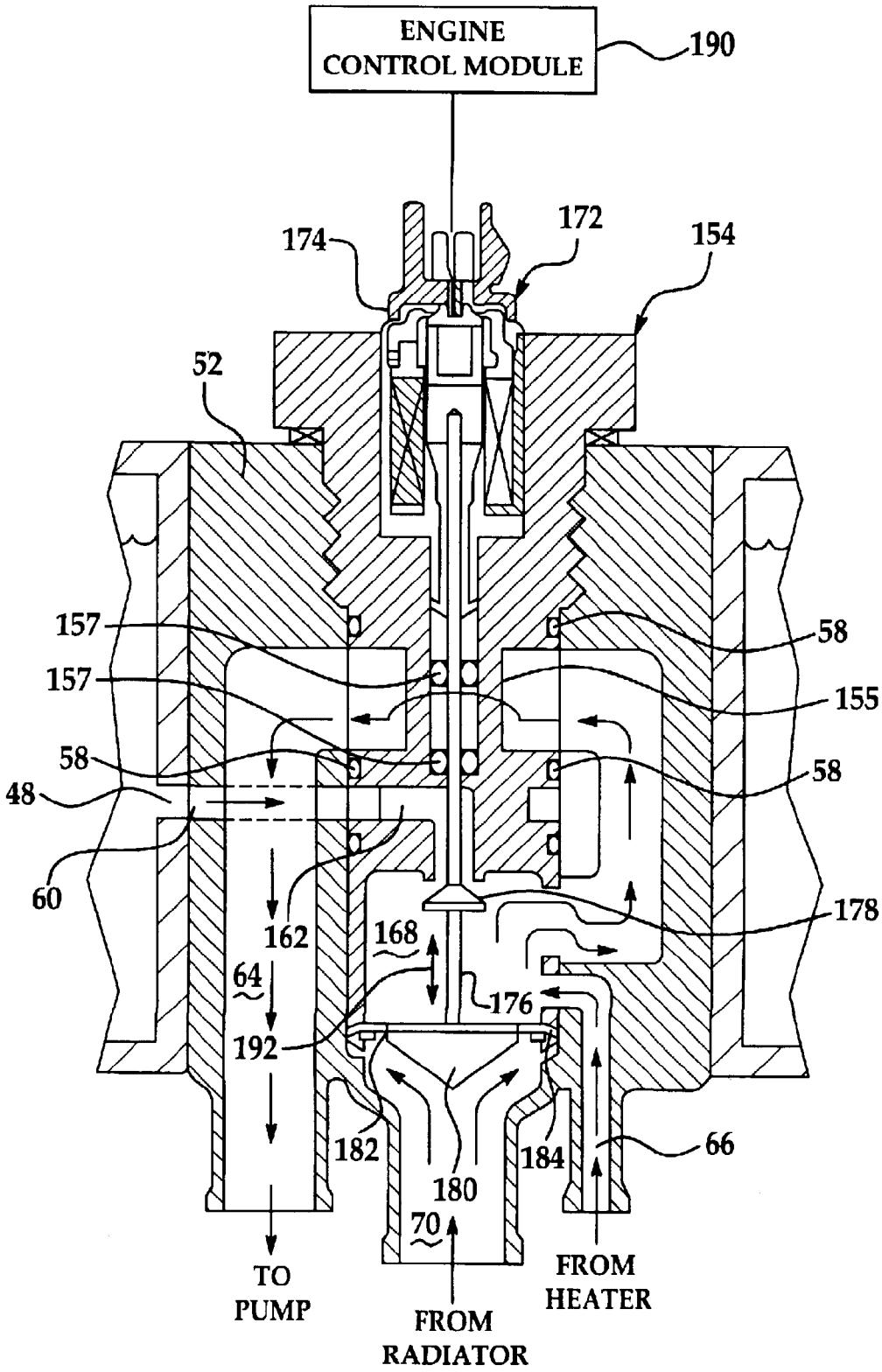
FIG. 4 is a second embodiment of a flow control module and an integrated thermostat and reservoir cap which may be used within the cooling system in an alternate embodiment of the invention, and which includes an electrically controlled thermostat.

Referring now to FIG. 4, there is shown an alternate embodiment of an integrated fill cap and thermostat assembly 154 which can be used in alternate embodiments of the invention. Thermostat assembly 154 is substantially identical in structure and function to assembly 54, with the exception that wax thermostat 72 has been replaced with an electronically controlled thermostat 172. Thermostat assembly 154 includes a narrowed portion 155 which is aligned with channel 64 when thermostat assembly 154 is fully attached to portion 52, thereby allowing coolant to pass "around" portion 155 and to traverse channel 64. Electronic thermostat 172 includes an electronic actuator 174 (which replaces wax element 74 in this embodiment). In one non-limiting embodiment, actuator 174 comprises a conventional stepper motor. Actuator 174 is communicatively coupled to an engine control module 190 or other controller which controls the operation of thermostat assembly 154 based upon certain vehicle or engine operating attributes. Thermostat assembly 154 includes a shaft 176 having a first valve end 178 which selectively covers the opening to bypass channel 162, thereby selectively preventing coolant from flowing through bypass channel 162. Shaft 176 further includes a second valve end 180 which selectively covers an aperture 182 formed within plate 184 which separates conduit 70 from chamber 168, thereby selectively preventing coolant from flowing from the radiator 18 to pump 20 through channel 64. Assembly 154 further includes internal seals 157 which engage shaft 176 and prevent coolant from passing into electronic actuator 172. Based upon vehicle or engine attribute data received and processed by the engine control module 190 (e.g., ambient temperature data, cabin or passenger compartment temperature data, coolant temperature data, engine operational data and other data), the actuator 174 selectively moves shaft 176 in the directions of arrows 192. Particularly, actuator 174 moves shaft 176 between the "bypass" position shown in FIG. 2, where valve end 180 blocks flow from the radiator 18, thereby causing all of the coolant 38 to bypass the radiator 18, and an "open" position, where valve end 178 blocks bypass channel 162 and opens aperture 182, thereby causing all of the coolant 38 to pass through radiator 18. By utilizing an electronic thermostat 172 which is controlled by the engine control module 190, the system 10 can selectively control the function of the cooling system based on a variety of vehicle or engine operating attributes, and can be effective to improve overall system performance, such as faster warm-up in cold ambient conditions, reduced high speed restriction, and improved drivability, performance and optimal emission control. For example and without limitation, during cold weather ambient conditions, the thermostat 172 can be programmed to run at a higher coolant temperature such as 220° F. rather than the normal 190° F., thereby providing for improved cabin heater/defroster performance. During hot weather ambient conditions, the thermostat 172 can be programmed to run at a lower coolant temperature such as 150° F. rather than the normal 190° F., thereby providing for improved cooling performance and decreasing the radiator cooling capacity heat rejection requirements. During wide-open throttle accelerations, the thermostat 172 can be programmed to run at a full open position with no temperature control to provide improved engine performance afforded by the lower coolant temperature. Also, during engine "over-heat" or "limp home" modes, the thermostat 172 can be programmed to run at a full open position to afford improved coolant flow and lower operating temperatures.

Figure 5:
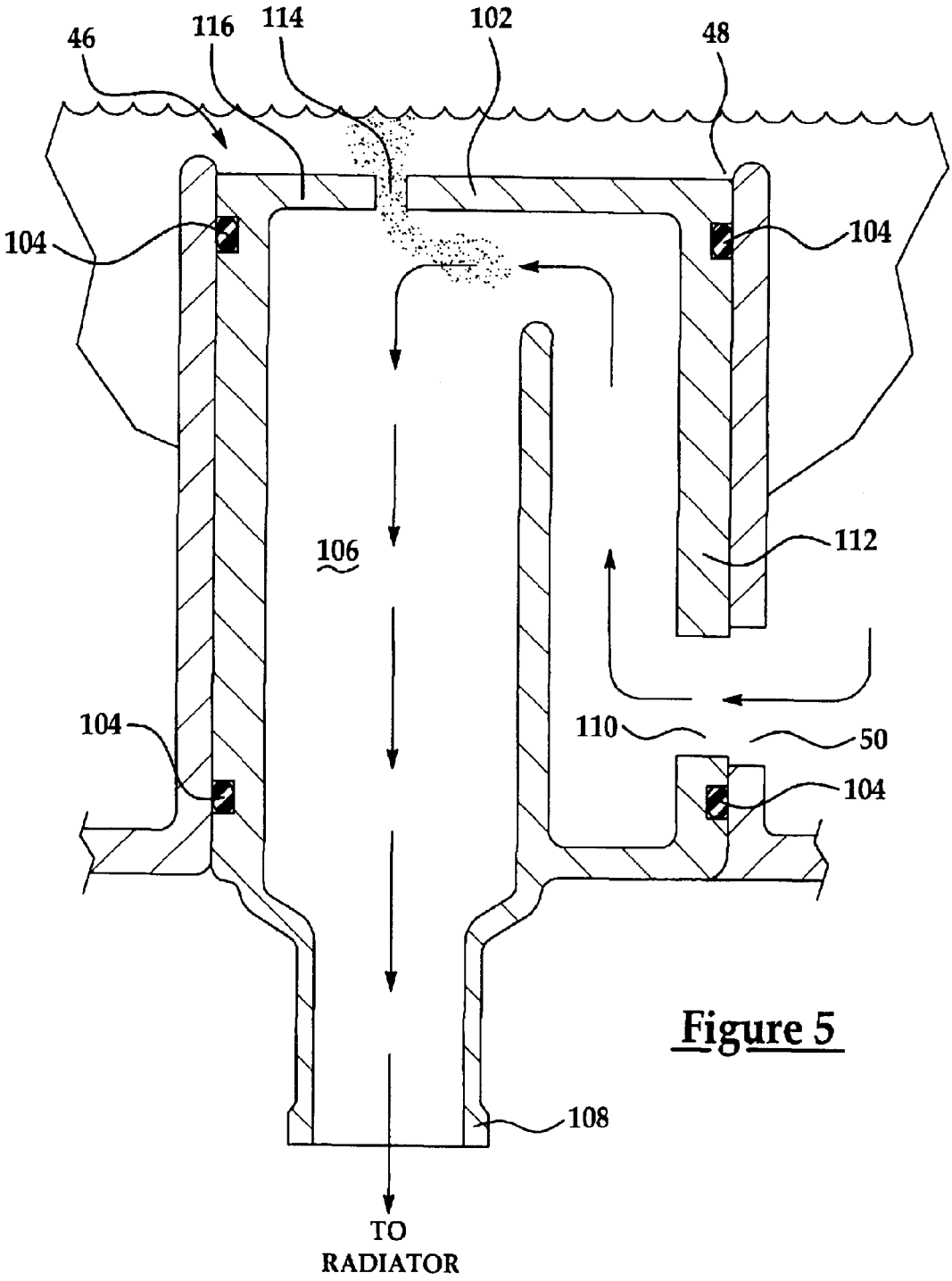
FIG. 5 is a partial view of the engine cooling system shown in FIG. 1 and illustrating a radiator outlet flow module which is used within the preferred embodiment of the invention.

Referring now to FIG. 5, there is shown the outlet flow module 46 used within the preferred embodiment of the invention. Module 46 includes a generally cylindrical housing 102 which is attached to housing 26 and sealed within channel 40 in a conventional manner (e.g., by use of o-ring seals 104. Housing 102 includes an interior channel 106 which is fluidly coupled to radiator 18 by use of port 108. Housing 102 further includes an aperture 110 located near the bottom of the side portion or wall 112 of housing 102 and which is aligned with aperture 50. Aperture 110 allows coolant 38 from reservoir housing 26 to be communicated into channel 106. Housing 102 further includes a small steam release aperture 114 which is formed within the top of housing 102 and which communicates with the top or "upper" portion of channel 106. Aperture 114 is effective to allow steam bubbles within coolant 38 to be released into the air dome chamber 36 before the coolant 38 enters the radiator 18. By eliminating steam bubbles from the coolant 38 prior to the coolant 38 entering the radiator 18, heat transfer within the radiator 18 is substantially improved. In alternate embodiments, outlet flow module 46 may be integrally formed with reservoir housing 26.

In operation, coolant 38 is pumped through the engine 14 by use of pump 20 and enters reservoir housing 26 through conduits 22, 24 and ports 28, 30. Some of the coolant 38 is passed through heater core 16 after passing through the engine and being heated. After passing through the heater core 16, the coolant enters thermostat chamber 68 through channel 66. During engine "warm-up", the coolant flowing through the engine 14 and heater 16 remains relatively cold, and thermostat 72 remains in the "bypass" position shown in FIGS. 2 and 3. When thermostat 72 is in this position, all flow from radiator 18 is blocked by valve end 80, and thus all coolant flow bypasses radiator 18, and traverses through aperture 48, channels 60, 62 and 64, and is recirculated through the engine 14 by pump 20. Once the coolant 38 entering chamber 68 from heater 16 reaches a certain temperature, the wax element 74 actuates the shaft 76 in the direction of arrow 86, effective to block bypass channel 62 and to open aperture 82, thereby causing all of the coolant 38 to flow through radiator 18 (from outlet flow module 46). In this manner, system 10 provides full control of the coolant bypass circuit for improved engine warm-up and cooling performance.

It is to be understood that the invention is not limited to the exact construction and method which has been delineated above, but that various changes and modifications may be made without departing from the spirit and the scope of the invention as is more fully set forth in the following claims.

What is claimed is:

1. An integrated fluid recovery reservoir and thermostat assembly for use within an engine cooling system of the type including an engine, a radiator, coolant and a pump which selectively circulates said coolant through said engine and said radiator, said assembly comprising:

a coolant reservoir housing which is mounted to said engine and which includes at least one inlet port for receiving said coolant from said engine and an outlet flow portion which is fluidly coupled to said radiator;

a flow control module which is attached to said reservoir housing and which selectively and fluidly communicates with said reservoir housing, with said pump and with said radiator; and a thermostat assembly which is attached to said flow control module, and which cooperates with said flow control module to selectively control the flow of said coolant through said engine cooling system, said thermostat assembly including a valve which is selectively movable between a first position in which said coolant bypasses said radiator and flows directly from said reservoir housing to said pump, and a second position which causes said coolant to be selectively channeled from said reservoir housing through said radiator prior to being channeled to said pump.

2. The assembly of claim 1 wherein said thermostat assembly is integrated within a fill cap which is removably attached to said flow control module, effective to allow said engine cooling system to be selectively filled with coolant when said fill cap is removed from said flow control module.

3. The assembly of claim 2 wherein said fill cap is threadingly coupled to said flow control module.

4. The assembly of claim 1 wherein said fluid control module is disposed within a channel which is formed within said reservoir housing.

5. The assembly of claim 1 wherein said thermostat assembly comprises a wax element.

6. The assembly of claim 1 wherein said thermostat comprises an electrical actuator.

7. The assembly of claim 1 wherein said reservoir housing comprises an air dome chamber which is formed on a top portion of said reservoir housing and which substantially prevents said cooling system from being overfilled with coolant.

8. The assembly of claim 1 wherein said outlet flow module comprises a top surface having an aperture which communicates with said reservoir housing and which is effective to allow steam bubbles within said coolant to escape into said reservoir housing prior to said coolant entering said radiator.

9. The assembly of claim 1 wherein said cooling system further comprises a heater which receives heated coolant from said engine, and wherein said flow control module is communicatively coupled to said heater and receives said heated coolant from said heater and communicates said received coolant to said thermostat assembly which moves said valve between said first and said second position based upon the temperature of said received coolant.

10. An engine cooling system comprising:

a radiator;

an engine;

a coolant reservoir housing which is mounted to said engine, which contains coolant, and which is fluidly coupled to said engine and said radiator;

a pump which selectively pumps said coolant from said reservoir housing to said engine and to said radiator; and a thermostat and flow control assembly which is disposed within said coolant reservoir housing, which is selectively and fluidly coupled to said radiator, said pump, and said reservoir housing, and which selectively causes said coolant to be pumped through said radiator and to bypass said radiator, based upon at least one engine operating attribute.

11. The engine cooling system of claim 10 wherein said coolant reservoir housing comprises a fill cap, and wherein said thermostat and flow control assembly comprises a thermostat valve which is integrally formed within said fill cap.

12. The engine cooling system of claim 11 wherein said thermostat valve is electronically controlled.

13. The engine cooling system of claim 11 wherein said thermostat valve is controlled by use of a wax element.

14. A method for channeling coolant within an engine cooling system including an engine, a radiator and a pump, said method comprising the steps of:

providing a coolant reservoir housing;

mounting said coolant reservoir housing to said engine;

fluidly coupling said coolant reservoir housing to said engine and to said radiator;

providing a fill cap for said coolant reservoir housing;

integrating a thermostat assembly within said fill cap for selectively channeling said coolant to said radiator;

coupling said thermostat assembly to said radiator and to said pump; and causing said thermostat assembly to selectively channel said coolant to said radiator based upon the temperature of said coolant.

15. The method of claim 14 wherein said thermostat assembly comprises a wax element.

16. The method of claim 14 wherein said thermostat assembly comprises an electrical actuator.

17. The method of claim 14 further comprising the step of: forming an air dome chamber within said coolant reservoir housing, effective to prevent overfilling of said engine cooling system.

18. The method of claim 14 wherein said integrated fill cap and thermostat assembly is threadingly coupled to said coolant reservoir housing.

19. The method of claim 18 wherein said thermostat assembly includes a valve which is movable between a first open position wherein all of said coolant passes through said radiator, and a second bypass position wherein all of said coolant bypasses said radiator.

* * * * *